US010028883B2

(12) United States Patent
Yenko et al.

(10) Patent No.: US 10,028,883 B2
(45) Date of Patent: Jul. 24, 2018

(54) SEXUAL PLEASURE ATTACHMENT FOR VIBRATION DEVICE AND METHOD

(71) Applicant: KandY Products, LLC, Orlando, FL (US)

(72) Inventors: Vincent Yenko, Orlando, FL (US); Lauren Kaplus, Orlando, FL (US)

( * ) Notice: Subject to any disclaimer, the term of this patent is extended or adjusted under 35 U.S.C. 154(b) by 289 days.

(21) Appl. No.: 14/064,117

(22) Filed: Oct. 26, 2013

(65) Prior Publication Data

US 2015/0119636 A1 Apr. 30, 2015

(51) Int. Cl.
*A61H 19/00* (2006.01)
*A61H 23/02* (2006.01)

(52) U.S. Cl.
CPC ..... *A61H 19/34* (2013.01); *A61H 19/44* (2013.01); *A61H 23/0254* (2013.01); *A61H 2201/0153* (2013.01); *A61H 2201/1685* (2013.01); *A61H 2201/1695* (2013.01)

(58) Field of Classification Search
CPC ..... A61H 19/34; A61H 19/00; A61H 19/44; A61H 2201/0153; A61H 2201/1685; A61H 2201/1695; A61H 23/0254
See application file for complete search history.

(56) References Cited

U.S. PATENT DOCUMENTS 4,829,991 A 5/1989 Boeck
5,573,499 A 11/1996 McAllister
2006/0195999 A1* 9/2006 Gaboury ..... A61H 19/34 15/246
2007/0129599 A1* 6/2007 Nan ..... A61H 19/44 600/38
2009/0005714 A1* 1/2009 Mecenero ..... A61H 19/34 601/46
2011/0009693 A1 1/2011 Borrero
2013/0178769 A1 7/2013 Schmidt

FOREIGN PATENT DOCUMENTS

NL 1006318 12/1998

OTHER PUBLICATIONS

Tingletip the ultimate vibrator, www.tingletip.com; last visited on Feb. 3, 2014.
My Celebrator Vibrator Sex Toy for Women, http://www.amazon.com/My-Celebrator-Womens-Vibe-Sex/dp/B000XKOWTC/ref=pd_sim_hpc_4; last visited on Feb. 3, 2014.
Sinclair Institute Better Sex Synergy Pleasure System Eroscillating Massager, http://www.amazon.com/Sinclair-Institute-Pleasure-Eroscillating-Massager/dp/B001JEPC2W/ref=pd_sim_hpc_3; last visited on Feb. 3, 2014.

* cited by examiner

*Primary Examiner* — Christine H Matthews
(74) *Attorney, Agent, or Firm* — Johnson & Martin, P.A.; James David Johnson

(57) ABSTRACT

A sexual attachment device is provided with a sleeve being removably installable over a source of vibration. The sleeve includes a top end, a bottom end, opening located at the bottom end, and a cavity located at least partially within the sleeve accessible via the opening. The source of vibration can be inserted at least partially into the cavity. Vibration generated by the source of vibration is transmittable via the sleeve. The source of vibration may be an electric toothbrush. A ring is includable at the top end with a ring opening. A method is provided for providing stimulation using the sexual attachment device.

3 Claims, 6 Drawing Sheets

SEXUAL PLEASURE ATTACHMENT FOR VIBRATION DEVICE AND METHOD

FIELD OF THE INVENTION

The invention relates to a device for sexual pleasure. More particularly, the invention relates to a device for sexual pleasure attachable to a source of vibration.

BACKGROUND

Sexual pleasure devices have long provided enhanced stimulation for people. Traditional vibrator devices include a vibration motor that drives an unbalanced weight, causing the device to vibrate. However, such devices are limited in the types of vibration provided. Additionally, such vibration devices are limited in function to only provide genital stimulation. Furthermore, traditional vibrator devices are not customizable, prohibiting a user from changing his or her experience received from the device.

What is needed is a sexual pleasure attachment that is attachable to a source of vibration to provide stimulation. What is needed is a sexual pleasure attachment that is interchangeable with the source of vibration. What is needed is a sexual pleasure attachment temporarily installable on a source of high frequency vibration. What is needed is a method of operating a sexual pleasure attachment installable on a source of vibration.

SUMMARY

The present invention provides a sexual attachment device that includes a sleeve that can be removably installed over a source of vibration. The source of vibration may be an electric and/or sonic toothbrush. The sleeve may include a top end, a bottom end, sides, an opening located at the bottom end, and a cavity located at least partially within the sleeve. The sleeve is accessible via the opening. The source of vibration can be inserted at least partially into the cavity. Vibration generated by the source of vibration is transmittable via the sleeve. In an embodiment of the present invention, a ring is includable at the top end with an opening. A method is provided for providing stimulation using the sexual attachment device.

The present invention provides a sexual pleasure attachment that is attachable to a source of vibration to provide stimulation. Additionally, the present invention provides a sexual pleasure attachment that is interchangeable with the source of vibration. Moreover, the present invention provides a sexual pleasure attachment temporarily installable on a source of high frequency vibration. The present invention also provides a method of operating a sexual pleasure attachment installable on a source of vibration.

According to an embodiment of the present invention, a sexual attachment device is provided that includes a sleeve. The sleeve may be removably installable over a source of vibration. The sleeve may include a top end, a bottom end, an opening, and a cavity. The bottom end may be located opposite the top end. The opening may be located at the bottom end. The opening may receive the source of vibration. The cavity may be located at least partially within the sleeve. The cavity may be accessible via the opening. The source of vibration may be insertable at least partially into the cavity. Vibration generated by the source of vibration is transmittable via the sleeve. The sleeve may be constructed using a material that is soft and cleanable.

In another aspect, the source of vibration may be an electric and/or sonic toothbrush.

In another aspect, the top end of the sleeve may be at least partially rounded.

In another aspect, at least part of the sleeve may be textured.

In another aspect, the sleeve may further include a side. The side may be approximately cylindrical and extend between the top end and the bottom end.

In another aspect, the sleeve may be constructed using silicone.

In another aspect, a ring is includable at the top end. The ring may include a ring opening approximately at a center of the ring.

According to an embodiment of the present invention, a device is disclosed for providing sexual stimulation. The device may include a sleeve removably installable over a source of vibration. The sleeve may include a top end, a bottom end, an opening, a cavity, and a side. The bottom end may be located opposite the top end. The opening may be located at the bottom end for receiving the source of vibration. The cavity may be located at least partially within the sleeve. The cavity is accessible via the opening. The side may be approximately cylindrical and extend between the top end and the bottom end. The source of vibration may be insertable at least partially into the cavity. The top end of the sleeve may be at least partially rounded.

In another aspect, the source of vibration may be an electric and/or sonic toothbrush.

In another aspect, vibration generated by the source of vibration is transmittable via the sleeve.

In another aspect, at least part of the sleeve may be textured.

In another aspect, the sleeve may be constructed using a material that is soft and cleanable.

In another aspect, the sleeve may be constructed using silicone.

In another aspect, a ring is includable at the top end. The ring may include a ring opening approximately at a center of the ring.

According to an embodiment of the present invention, a method is disclosed for providing stimulation using a sexual attachment device. The method may include inserting a source of vibration at least partially into a sleeve. The sleeve may include a top end, a bottom end, an opening, and a cavity. The bottom end of the sleeve may be located opposite the top end. The opening may be located at the bottom end. The cavity may be located at least partially within the sleeve. The cavity is accessible via the opening. The method may also include installing the source of vibration at least partially into the cavity. Additionally, the method may include operating the source of vibration to create a vibration. Moreover, the method may include transmitting the vibration using the sleeve. The sleeve may be constructed using a material that is soft and cleanable. Furthermore, the method may include applying the sexual attachment device to an area to be stimulated. The sleeve is removably installable over the source of vibration. Vibration generated by the source of vibration is transmittable via the sleeve. At least part of the sleeve may be textured.

In another aspect of the method, the source of vibration is an electric and/or sonic toothbrush.

In another aspect of the method, the top end of the sleeve may be at least partially rounded.

In another aspect of the method, the sleeve may include a side. The side may be approximately cylindrical and extend between the top end and the bottom end.

In another aspect of the method, the sleeve may be constructed using silicone.

In another aspect of the method, a ring is includable at the top end. The ring may include a ring opening approximately at a center of the ring. The method may further include positioning the ring adjacent to the area to be stimulated. The area to be stimulated may be insertable at least partially through the opening.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 2:
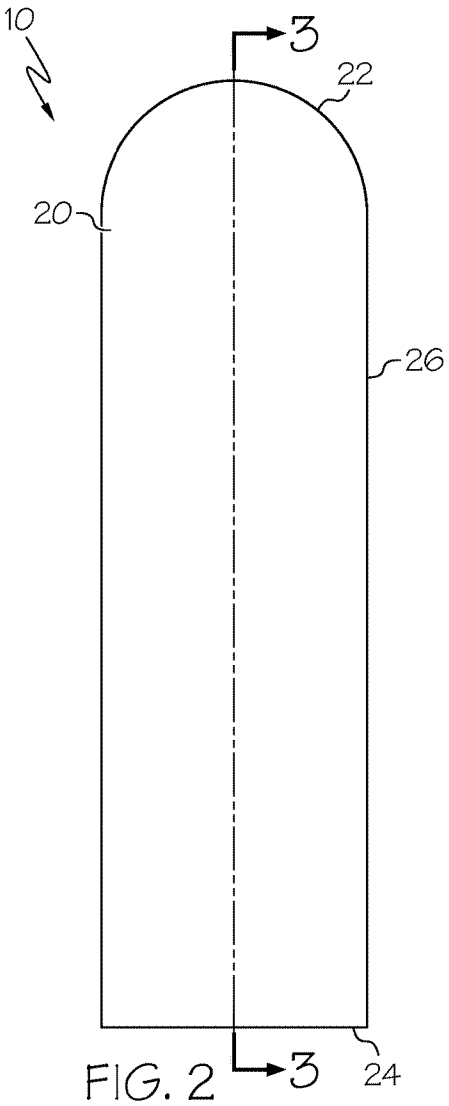
FIG. 2 is a front elevation view of the sexual attachment device, according to an embodiment of the present invention.
Figure 1:
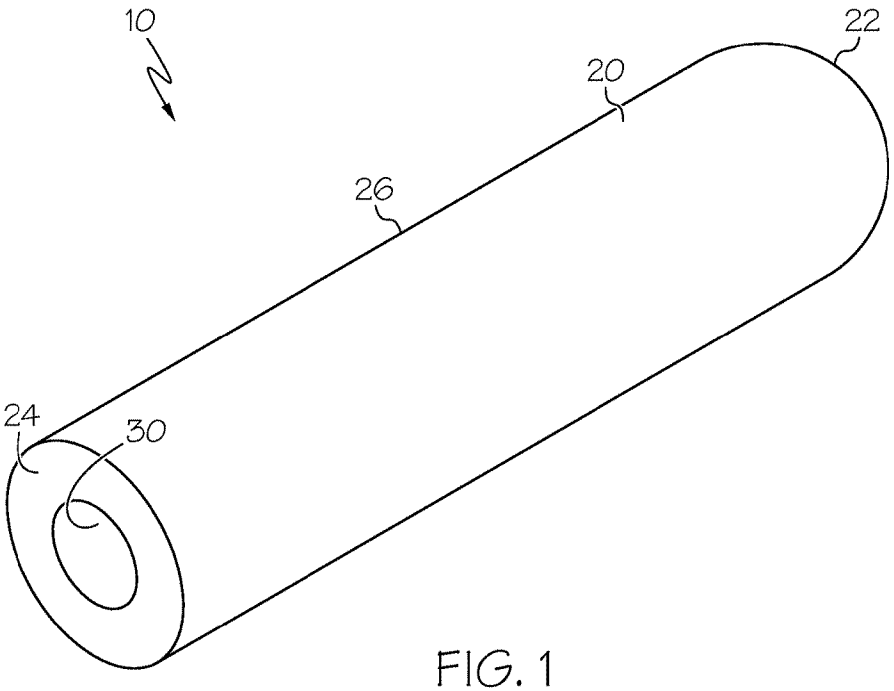
FIG. 1 is a perspective drawing of the sexual attachment device, according to an embodiment of the present invention.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The invention generally relates to a device for sexually stimulating a person. In one embodiment, the invention may relate to a device for sexually stimulating the genitals of a female using vibration. Additional embodiments may be provided relating to stimulation of a male. To provide the stimulation, the device may be located adjacent to an area of the body, or inserted into an opening in the body, to receive the targeted stimulation.

Referring now to FIGS. 1-5, the device may include a sleeve-shaped attachment device that can be placed over a source of vibration 50. The attachment may include a top 22, a bottom 24, an approximately cylindrical side 26, and inner and outer surfaces. The side 26 may additionally be configured with other shapes and/or textures. A cavity 40 may be included at least partially in the interior of the sleeve 20. The bottom of the attachment device 10 may be approximately flattened and may contact or be fitted to the source of vibration 50. The top of the attachment device 10 may be rounded in a dome-like shape. The side 26 of the attachment may extend upwardly from the bottom end 24 to the top end 22 of the attachment device 10, maintaining an approximately cylindrical shape as the side 26 ascends. The side 26 may taper slightly as it approaches the top of the attachment device 10, terminating at a rounded top end 22. In an embodiment, the device may be configured in a variety of shapes and textures, for example, like a human finger.

An opening 30 may be provided at the bottom end 24 of the attachment. The opening 30 may be configured to receive the source of vibration 50 or an optional extension 52 extending outwardly from the source of vibration 50. In one embodiment, the source of vibration 50 may be inserted at least partially into the opening 30. An example of a source of vibration 50 may include an electric and/or sonic toothbrush. Optimally, the sleeve 20 may fit snugly over the source of vibration 50 and/or extension 52 to optimally transmit the vibration from the source of the vibration 50 through the attachment 10 to a portion of a user being contacted by the device.

The attachment 10, including the sleeve 20, may be constructed using a soft material capable of transmitting vibration, such as silicone, latex, or rubber. The material may be soft and cleanable. Alternatively, the device may be constructed with other materials typically used in sexual pleasure devices. The material is optimally safe for use with water-based lubricants and insertion into the body of a user. The material may also be configurable in a variety of colors.

Continuing reference to FIGS. 1-5, the sleeve 20 will now be discussed in greater detail. The sleeve 20 may be removably installable over the source of vibration 50. As discussed above, the sleeve 20 may include a top end 22, a bottom end 24 located opposite the top end 22, and sides 26. An opening 30 may be located at the bottom end 24 for receiving the source of vibration 50. The sleeve 20 may include a cavity 40 located at least partially within the sleeve 20. The cavity 40 may be accessible via the opening 30. The source of vibration 50 may be insertable at least partially into the cavity 40.

In the interest of clarity, an illustrative example of sleeve will now be discussed. Skilled artisans will appreciate that the following example is being provided to clearly illustrate one possible configuration of the invention and it not intended to limit the present invention in any way. In this example, the sleeve may be approximately 60 millimeters long, between its top end 22 and its bottom end 24. Skilled artisans will appreciate additional embodiments to include 30, 35, 40, 45, 50, 55, 65, 70, 75, 80, 85, 90, 95, or another length in millimeters for the sleeve. The top end of this illustrative sleeve may be rounded. The bottom end of this illustrative sleeve may be substantially flat and have a diameter of approximately 16 millimeters. Skilled artisans will appreciate additional embodiments of the bottom end to include a diameter of 5, 10, 12, 13, 14, 15, 17, 18, 19, 20, 22, 25, 30, or another diameter in millimeters.

The illustrative sleeve may include a cavity located within the interior of material used to form the sleeve. The cavity may be accessible via an opening, which may measure 7 millimeters in diameter and be located approximately at the center of the bottom end. Skilled artisans will appreciate additional embodiments of the opening to include a diameter of 2, 3, 4, 5, 6, 8, 9, 10, 11, 12, 13, 14, 15, 16, 17, 18, 19, 20, or another diameter in millimeters. The remaining area of the bottom end may include the material of the sleeve.

The cavity 40 may be an area of removed material within the interior of the sleeve 20. In some embodiments, the cavity 40 may be approximately cylindrical at its interior sides.

The illustrative example may include a cavity that may extend approximately 50 millimeters into the sleeve. Skilled artisans will appreciate additional embodiments to include 20, 25, 30, 35, 40, 45, 55, 60, 65, 70, 75, 80, 85, or another length in millimeters for the cavity. The cavity may have a diameter of approximately 16 millimeters. Skilled artisans will appreciate additional embodiments of the cavity to include a diameter of 1, 2, 3, 4, 5, 6, 8, 9, 10, 11, 12, 13, 14, 15, 17, 18, 19, 20, 22, 25, 30, or another diameter in millimeters.

Figure 5:
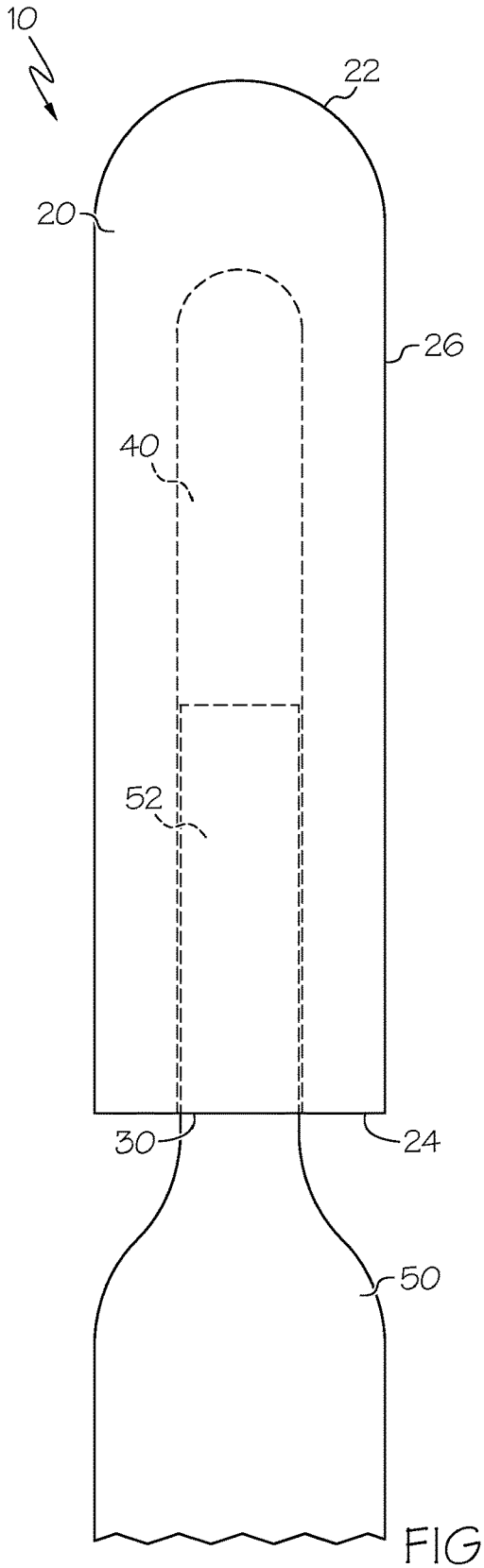
FIG. 5 is a front elevation view of the sexual attachment device receiving a source of vibration, according to an embodiment of the present invention.

Referring now to FIG. 5, the source of vibration 50 will now be discussed in greater detail. The source of vibration 50 may be virtually any device that provides a vibrating and/or oscillating motion. For example, the source of vibration may be an electric and/or sonic toothbrush. In the interest of this disclosure, the term "electric toothbrush" encompasses both electric and sonic toothbrushes. The source of vibration may provide oscillating, rotating, pulsating, sweeping, brushing, and/or other motions that would be apparent to a skilled artisan after having the benefit of this disclosure.

The source of vibration 50 may optionally include an extension 52, which may be insertable into the cavity 40 of the sleeve 20. The extension 52 may extend outwardly from the source of vibration 50. An illustrative method of using the source of vibration 50 with the device of the present invention is discussed in greater detail below.

Figure 4:
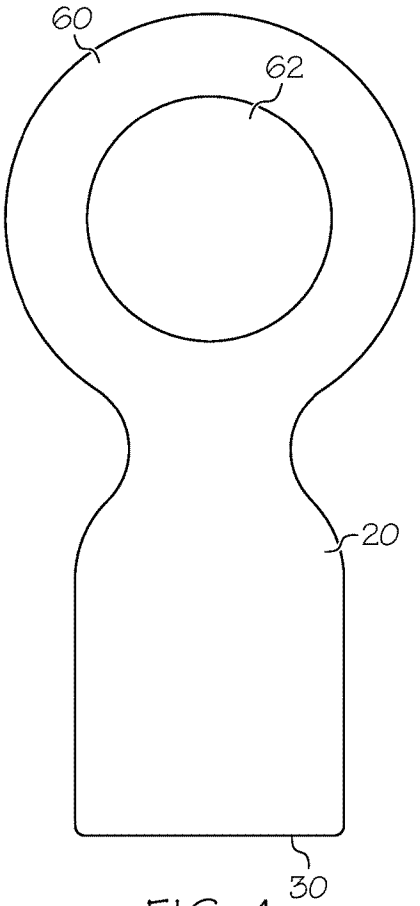
FIG. 4 is a front elevation view of the sexual attachment device including a ring, according to an embodiment of the present invention.
Figure 3:
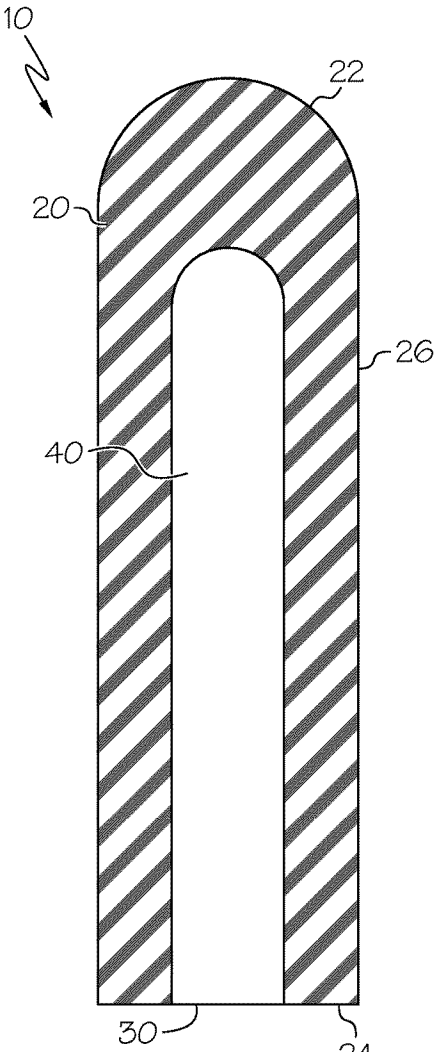
FIG. 3 is a cross-sectional view of the sexual attachment device of FIG. 3.

Referring now additionally to FIG. 4, an embodiment usable for male stimulation will now be discussed. Those of skill in the art will appreciate that all other embodiments discussed throughout this disclosure may also be used for female and/or male stimulation. Here, the sleeve 20 may include a ring 60 at its top end. The ring 60 may include a ring opening 62 approximately at a center of the ring 60. The outer surface of the ring 60 may be positioned adjacent to an area on a user to be stimulated. Alternatively, the area of the user may be at least partially inserted into the ring opening 62 of the ring 60. Vibration may be transmittable from the source of vibration through the ring 60.

Additional embodiments of the present invention may include a sleeve that is at least partially rounded. Moreover, additional embodiments of the present invention may include a sleeve that is textured. Numerous combinations of shapes and textures may be used with the sleeve to provide varying types of stimulation to a user. In the interest of clarity, various embodiments will now be discussed to describe some possible configurations, without limitation.

Embodiments of FIGS. 6-18 illustrate various embodiment of the present invention. Skilled artisans should appreciate that FIGS. 6-18 are provided as examples only, and are not intended to limit the scope of the present invention to only those examples. Components of the present invention, such as the sleeve, may be configured in many additional shapes and/or textures, as would be apparent after having the benefit of this disclosure.

Figure 6:
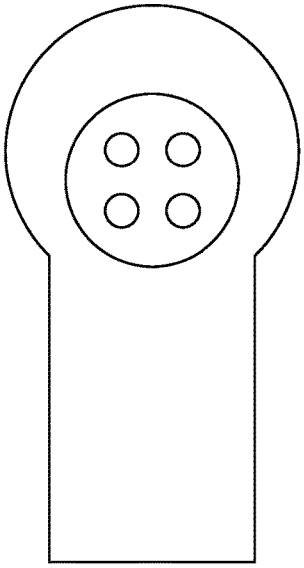
FIGS. 6-18 are front elevation views of example embodiments of the sexual attachment device.

Referring now to FIG. 6, an alternative embodiment of the sexual attachment device will now be discussed. In this embodiment, the device may include a sleeve shaped to having a cupped area with protruding nub massagers. To this effect, the sleeve may include an at least partially indented area of the material to engage a part of the user to be stimulated. The nub massagers may be positioned adjacent to an area to be stimulated. Vibration may be transmitted from the source of vibration through the sleeve configured in this manner. The sleeve of this embodiment may include a cavity.

Figure 7:
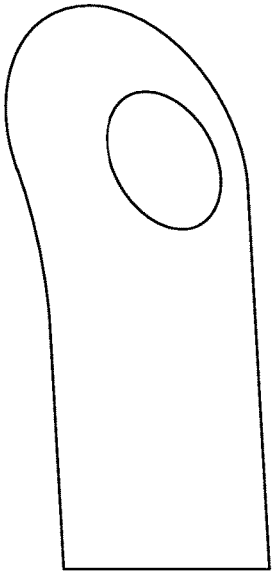

Referring now to FIG. 7, an alternative embodiment of the sexual attachment device will now be discussed. In this embodiment, the device may include a sleeve shaped to include a cupped area with a smooth surface. To this effect, the sleeve may include a concave region near its top end to engage an area to be stimulated. Vibration may be transmitted from the source of vibration through the sleeve configured in this manner. The sleeve of this embodiment may include a cavity.

Figure 8:
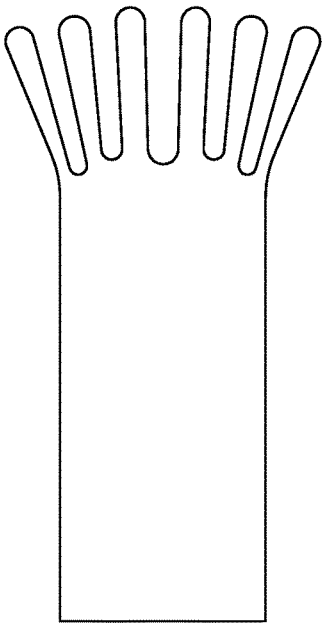

Referring now to FIG. 8, an alternative embodiment of the sexual attachment device will now be discussed. In this embodiment, the device may include a sleeve shaped to resemble tassels and/or flanges. To this effect, the sleeve may include outwardly extending lengths of material to engage an area to be stimulated. Vibration may be transmitted from the source of vibration through the sleeve configured in this manner. The sleeve of this embodiment may include a cavity.

Figure 9:
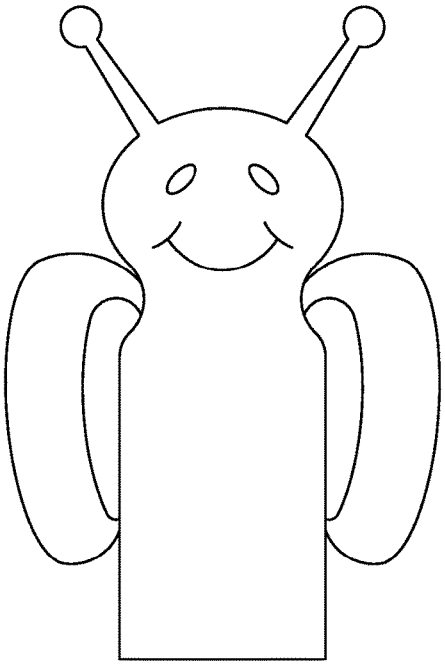

Referring now to FIG. 9, an alternative embodiment of the sexual attachment device will now be discussed. In this embodiment, the device may include a sleeve shaped to resemble an insect, such as a bee. To this effect, the sleeve may include elongated lengths extending from the sleeve near the top end, which may resemble antennae. This embodiment may also include wing-like flanges extending from the sides of the sleeve. A graphic may be printed on the sleeve to resemble a face. One or more parts of the bee embodiment may be positioned to engage an area to be stimulated. Vibration may be transmitted from the source of vibration through the sleeve configured in this manner. The sleeve of this embodiment may include a cavity.

Figure 10:
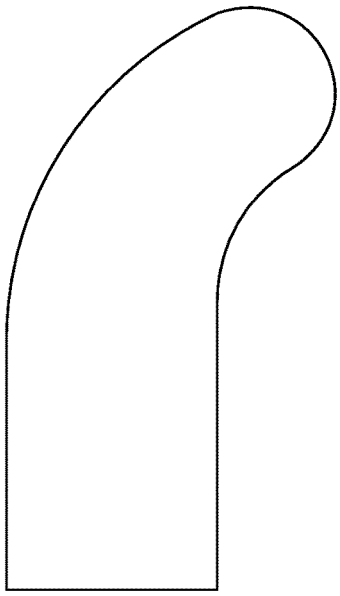

Referring now to FIG. 10, an alternative embodiment of the sexual attachment device will now be discussed. In this embodiment, the device may include a sleeve shaped to include a bend. To this effect, the sleeve may include a bend in the material along the length of the side to engage an area to be stimulated. The bend may allow this embodiment to engage areas for stimulation otherwise unreachable with other devices. Vibration may be transmitted from the source of vibration through the sleeve configured in this manner. The sleeve of this embodiment may include a cavity.

Figure 11:
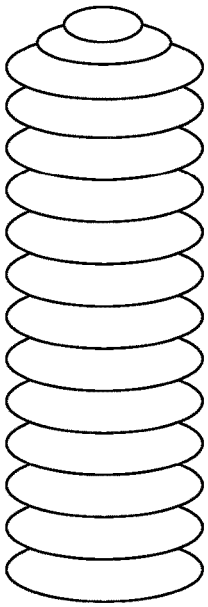

Referring now to FIG. 11, an alternative embodiment of the sexual attachment device will now be discussed. In this embodiment, the device may include a sleeve shaped to resemble a ribbed structure. To this effect, the sleeve may include changing diameters of the sleeve along the length of its side to engage an area to be stimulated. Vibration may be transmitted from the source of vibration through the sleeve configured in this manner. The sleeve of this embodiment may include a cavity.

Figure 12:
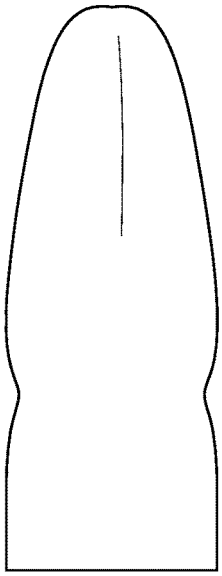

Referring now to FIG. 12, an alternative embodiment of the sexual attachment device will now be discussed. In this embodiment, the device may include a sleeve shaped to resemble a tongue. To this effect, the sleeve may include tongue-like rounding at its top end, shape configurations resembling a tongue, and/or texture of a tongue to engage an area to be stimulated. Vibration may be transmitted from the source of vibration through the sleeve configured in this manner. The sleeve of this embodiment may include a cavity.

Figure 13:
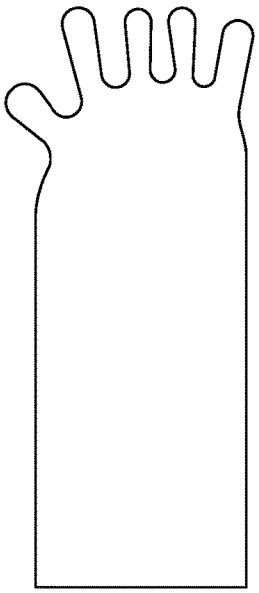

Referring now to FIG. 13, an alternative embodiment of the sexual attachment device will now be discussed. In this embodiment, the device may include a sleeve shaped to resemble a hand. To this effect, the sleeve may include a thumb and/or fingers extending outwardly from the top end of the sleeve to engage an area to be stimulated. Vibration may be transmitted from the source of vibration through the sleeve configured in this manner. The sleeve of this embodiment may include a cavity.

Figure 14:
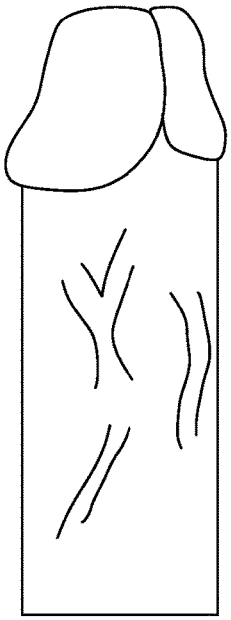

Referring now to FIG. 14, an alternative embodiment of the sexual attachment device will now be discussed. In this embodiment, the device may include a sleeve shaped to resemble a penis. To this effect, the sleeve may include shaping and texturing to resemble male genitalia, including, for example, a shaft, glans, meatus, foreskin, corona, veins, and/or other features of a penis to engage an area to be stimulated. Vibration may be transmitted from the source of vibration through the sleeve configured in this manner. The sleeve of this embodiment may include a cavity.

Figure 15:
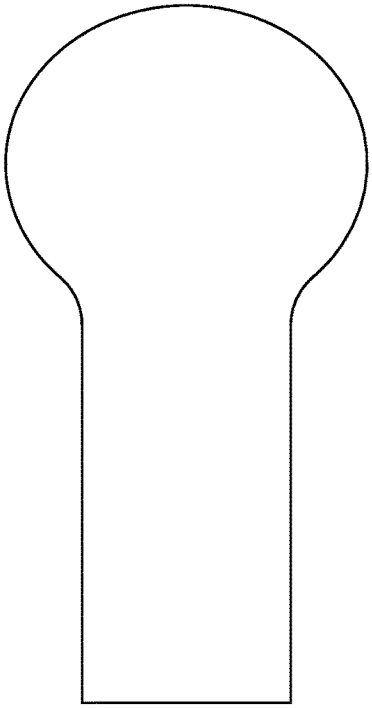

Referring now to FIG. 15, an alternative embodiment of the sexual attachment device will now be discussed. In this embodiment, the device may include a sleeve shaped to resemble a bulbous object. To this effect, the sleeve may include an enlarged bulb-like shape at its top end to engage an area to be stimulated. Vibration may be transmitted from the source of vibration through the sleeve configured in this manner. The sleeve of this embodiment may include a cavity.

Figure 16:
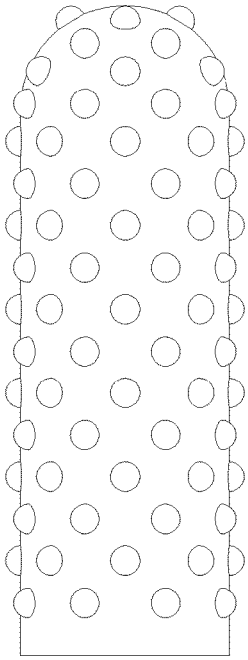

Referring now to FIG. 16, an alternative embodiment of the sexual attachment device will now be discussed. In this embodiment, the device may include a sleeve shaped to resemble a bumpy object. To this effect, the sleeve may include a plurality of extending nubs or protrusions to engage an area to be stimulated. Vibration may be transmitted from the source of vibration through the sleeve configured in this manner. The sleeve of this embodiment may include a cavity.

Figure 17:
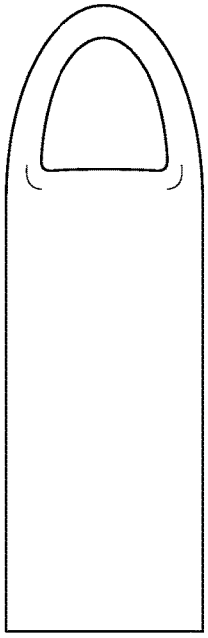

Referring now to FIG. 17, an alternative embodiment of the sexual attachment device will now be discussed. In this embodiment, the device may include a sleeve shaped to resemble a finger. To this effect, the sleeve may include the shaping and texturing of a finger, which may optionally include a simulated fingernail, to engage an area to be stimulated. Vibration may be transmitted from the source of vibration through the sleeve configured in this manner. The sleeve of this embodiment may include a cavity.

Figure 18:
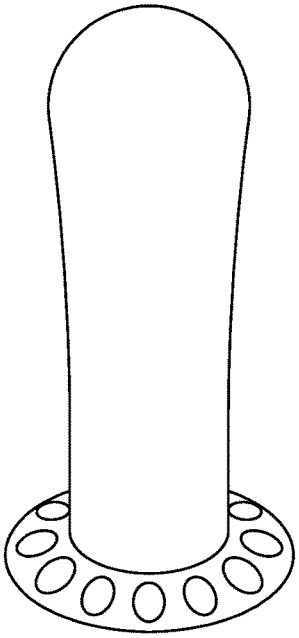

Referring now to FIG. 18, an alternative embodiment of the sexual attachment device will now be discussed. In this embodiment, the device may include a sleeve shaped to resemble a spaceship. To this effect, the sleeve may include a base and an extension, each of which may include similar or differing textures to engage an area to be stimulated. For example, the base may include nubs similar to the embodiment of FIG. 16 and the extension may be approximately smooth. Vibration may be transmitted from the source of vibration through the sleeve configured in this manner. The sleeve of this embodiment may include a cavity.

In operation, the device may be located adjacent to an area of a person and be vibrated to provide stimulation. More specifically, the source of vibration can be set to enable vibration, which may be transmitted through the sleeve. The sleeve may be pressed against or inserted into the body of the user, providing sexual stimulation.

An illustrative method performed for providing stimulation using a sexual attachment device will now be discussed. Skilled artisans will appreciate that the following method is described in the interest of clearly illustrating an embodiment of the present invention. Those of skill in the art will also appreciate additional methods that may be performed for providing stimulation after having the benefit of this disclosure.

The method may include inserting a source of vibration at least partially into a sleeve. As discussed above, the source of vibration may be an electric and/or sonic toothbrush, without limitation. The method may also include installing the source of vibration at least partially into the cavity. The source of vibration may be removably installed in to the cavity by inserting the source of vibration through the opening and into the cavity. The source of vibration may also be removed from the cavity by withdrawing the source of vibration from the cavity.

Once the source of vibration has been temporarily installed in the cavity, the method may include operating the source of vibration to create a vibration. The method may additionally include transmitting the vibration using the sleeve. For example, the vibration may be transmitted form the source of vibration through the sleeve and to an area contacted by the device. To enhance transmission of the vibration, the sleeve may be constructed using a material that is soft and cleanable, such as silicone, rubber, or another suitable material.

The method may further include applying the sexual attachment device to an area to be stimulated. Here, as the source of vibration provides vibration, and as the vibration is at least partially transmitted via the sleeve, the device may vibrate against the area to be stimulated. This vibration may provide stimulation to the area, for example, sexual stimulation.

In one embodiment of the method, the sexual attachment device may include a ring at the top end. The right may include an opening approximately at a center of the ring. In this embodiment, the method may further include positioning the ring adjacent to the area to be stimulated. Optionally, the area to be stimulated is insertable at least partially through the opening.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A device for sexually stimulating a person, the device consisting of:

an electric toothbrush comprising a source of vibration and an extension extending outwardly from the source of vibration; and a sleeve being removably installable by tension or friction over the source of vibration and the extension, and wherein the sleeve covers the extension of the source of vibration, the sleeve comprising:

a top end, a bottom end located opposite the top end, wherein the bottom end is flattened or fitted to the source of vibration, an opening located at the bottom end for receiving the extension and the source of vibration, and a cavity located at least partially within the sleeve, the cavity being accessible via the opening, the source of vibration and the extension being insertable at least partially into the cavity;

wherein vibration generated by the source of vibration is transmittable via the sleeve;

wherein the sleeve includes shaping and texturing to resemble a penis;

wherein the source of vibration is snugly installable within the cavity of the sleeve;

wherein the sleeve and the extension are coaxial when the sleeve is installed over the extension; and wherein the extension, covered by the sleeve, is insertable into a vaginal or anal cavity for internal stimulation.

2. A device for providing internal and external sexual stimulation consisting of:

an electric toothbrush comprising a source of vibration and an extension extending outwardly from the source of vibration; and a sleeve being removably installable by tension or friction over the source of vibration and the extension, and wherein the sleeve covers the extension of the source of vibration, the sleeve comprising:

a top end, a bottom end located opposite the top end, wherein the bottom end is flattened or fitted to the source of vibration, an opening located at the bottom end for receiving the extension and the source of vibration, a cavity located at least partially within the sleeve, the cavity being accessible via the opening, and a side that is approximately cylindrical extending between the top end and the bottom end;

wherein the source of vibration is insertable at least partially into the cavity;

wherein the top end of the sleeve is at least partially rounded;

wherein the source of vibration is snugly installable within the cavity of the sleeve;

wherein the sleeve and the extension are coaxial when the sleeve is installed over the extension;

wherein the extension, covered by the sleeve, is insertable into a vaginal or anal cavity for internal stimulation; and wherein the sleeve includes shaping and texturing to resemble a penis.

3. A method of providing external and internal stimulation, the method consisting of the steps of:

(a) providing an electric toothbrush comprising a source of vibration and an extension extending outwardly from the source of vibration, and inserting the source of vibration and the extension of the source of vibration at least partially into a sleeve of a sexual attachment device, the sleeve comprising:

a top end, a bottom end located opposite the top end, wherein the bottom end is flattened or fitted to the source of vibration, an opening located at the bottom end, and a cavity located at least partially within the sleeve, the cavity being accessible via the opening;

wherein the sleeve and the extension are coaxial when the sleeve is installed over the extension;

(b) installing the extension and the source of vibration at least partially into the cavity;

(c) operating the source of vibration to create a vibration;

(d) transmitting the vibration using the sleeve, the sleeve being shaped and textured to resemble a penis; and (e) applying the sexual attachment device to an area to be stimulated;

wherein the sleeve is removably installable over the extension and the source of vibration;

wherein the vibration generated by the source of vibration is transmittable via the sleeve;

wherein at least part of the sleeve is textured;

wherein the source of vibration is snugly installable within the cavity of the sleeve; and wherein the extension, covered by the sleeve, is insertable into a vaginal or anal cavity for internal stimulation.

* * * * *